US005979461A

United States Patent [19]

Bensalem et al.

[11] Patent Number: 5,979,461

[45] Date of Patent: Nov. 9, 1999

[54] SMOKING ARTICLE WRAPPER HAVING FILLER OF HYDROMAGNESITE/ MAGNESIUM HYDROXIDE AND SMOKING ARTICLE MADE WITH SAID WRAPPER

[75] Inventors: Azzedine Bensalem, Brooklyn, N.Y.; Warren Chang, Yong Ho, Taiwan; Jay A Fournier, Richmond, Va.; Andrew G. Kallianos, Asheville, N.C.; John B. Paine, III, Midlothian; Kenneth F. Podraza, Richmond, both of Va.; Donald M. Schleich, Carquefou, France; Jeffrey I. Seeman, Richmond, Va.

[73] Assignee: Philip Morris Inc., New York, N.Y.

[21] Appl. No.: 08/823,395

[22] Filed: Mar. 24, 1997

[51] Int. Cl.[6] ..... A24D 1/02

[52] U.S. Cl. ..... 131/365; 162/139; 162/181.2; 162/181.4

[58] Field of Search ..... 131/365, 360; 162/139, 158, 181.4, 181.2; 423/419.1, 430

[56] References Cited

U.S. PATENT DOCUMENTS

| | | | |
|---|---|---|---|
| 935,418 | 9/1909 | Sisson . | |
| 1,361,324 | 12/1920 | Grunwald . | |
| 1,971,909 | 8/1934 | Greider | 23/201 |
| 2,549,408 | 4/1951 | Atchison | 23/67 |
| 2,673,565 | 3/1954 | Schur et al. | 131/15 |
| 2,801,636 | 8/1957 | Pfoh | 131/15 |
| 4,231,377 | 11/1980 | Cline et al. | 131/9 |
| 4,420,002 | 12/1983 | Cline | 131/334 |
| 4,433,697 | 2/1984 | Cline et al. | 131/365 |
| 4,450,847 | 5/1984 | Owens | 131/365 |
| 4,561,454 | 12/1985 | Guess | 131/365 |
| 4,805,644 | 2/1989 | Hampl, Jr. et al. | 131/365 |
| 4,881,557 | 11/1989 | Martin | 131/365 |
| 4,915,118 | 4/1990 | Kaufman et al. | 131/365 |
| 4,941,485 | 7/1990 | Perfetti et al. | 131/365 |
| 4,984,589 | 1/1991 | Riedesser | 131/365 |
| 5,092,306 | 3/1992 | Bokelman et al. | 131/365 |
| 5,121,759 | 6/1992 | Dixit et al. | 131/365 |
| 5,131,416 | 7/1992 | Gentry | 131/365 |
| 5,220,930 | 6/1993 | Gentry | 131/365 |
| 5,228,463 | 7/1993 | Fournier et al. | 131/365 |
| 5,253,660 | 10/1993 | Dixit et al. | 131/365 |
| 5,699,811 | 12/1997 | Paine, III | 131/365 |

FOREIGN PATENT DOCUMENTS

| | | | |
|---|---|---|---|
| 0404580 | 12/1990 | European Pat. Off. | A24D 1/02 |
| 544907 | 5/1942 | United Kingdom . | |
| 548197 | 9/1942 | United Kingdom . | |
| 1289766 | 9/1972 | United Kingdom | A24C 3/14 |
| 2160084 | 12/1985 | United Kingdom | A24D 3/04 |

OTHER PUBLICATIONS

V.R. Choudhary et al. "Influence of Precipitation Conditions of Magnesium Hydroxide on its Thermal Decomposition in the Preparation of Active MgO" Thermochimic a Acta, 194, pp. 361–373, 1992.

T. Lopez et al. "Synthesis of Magnesium Oxide bvy the Sol–Gel Method: Effect of the pH on the Surface Hydroxylation" Journal of Catalysis, 127 pp. 75–85, 1991.

C. Sanchez et al. "Sol–Gel Chemistry from Metal Alkoxide Precursors" New J. Chem., 14 pp. 513–521, 1990.

Menzel et al. Studien An Kohlensauren Magnesiumsalzen. I. Basische Magnesiumcarbonate. Z. Electrochem., 1930.

Doelter et al. Weitere vorläufige Mitteilungen über Arbeiten auf dem Grenzgebietezwischen Kolloidchemie, Mineralogie und Geologie, Z. Ch. Ind. Koll., 1909.

(List continued on next page.)

*Primary Examiner*—Peter Chin
*Assistant Examiner*—Steven B. Leavitt
*Attorney, Agent, or Firm*—James T. Moore; Kevin B. Osborne; Charles E.B. Glenn

[57] ABSTRACT

Hydromagnesite-magnesium hydroxide compositions which, when used as fillers in smoking article wrappers, significantly reduce the amount of sidestream smoke produced by the burning smoking article while providing the smoking article with good subjective characteristics.

34 Claims, 9 Drawing Sheets

500 X 1000 X

OTHER PUBLICATIONS

L. Walter–Levy Contribution á l'étude de la double dècomposition entre les solutions de sulfate de magnèsium et de carbonate de potassium, à l'bullition Séance du, 1936.

L.Walter–Levy Carbonates basiques de magnésium. Acadénue Des Sciences, 1935.

Milton et al. New Minerals, Reedmergnerite and Eitelite Associated With Leucosphente, Shortite, Searlesite, and Crocidolite In The Green River Formation, Utah The American Mineralogist, 1955.

Berak et al. Wplyw weglanu nastopien dyspersji oraz zachowanie termiczne wytracanego wodorotlenku magnezowego Przemysl Chemiczny, 1960.

Etude sur les Carbonates de Magnésie: pp. 1021–1022; 1065–1069; 1114–1118 La Papeterie, 1920.

Brausser A Propos Des Propriétés De L'Eitelite $Na_2Mg(CO_3)_2$ Bulletin de la Société Royale, 1967.

Frankis et al. Subsolidus Relations in the System $Na_2CO_3$–$CaCo_3$–$H_2O$ Nature Physical Science, 1973.

McKie Subsolidus phase relations in the system $K_2Ca(CO_3)_2$–$Na_2Mg(CO_3)_2$ at 1 kbar: The fairchildite$_{ss}$ – buetschliite–eitelite eutectoid American Mineralogist, 1990.

Deelman Low–temperature synthesis of eitelite, $Na_2CO_3.MgCO_3$ N. Jb. Miner. Mn., 1984.

Pabst The Crystallography and Structure of Eitelite, $Na_2Mg(CO_3)_2$ American Mineralogist, 1973.

Chemical Abstracts, vol. 15, p. 1074.

500 X 1000 X

SMOKING ARTICLE WRAPPER HAVING FILLER OF HYDROMAGNESITE/ MAGNESIUM HYDROXIDE AND SMOKING ARTICLE MADE WITH SAID WRAPPER

FIELD OF THE INVENTION

The present invention relates to inorganic magnesium compositions which may be used as novel fillers for smoking article wrappers. The invention also relates to novel processes for producing these compositions.

DESCRIPTION OF THE PRIOR ART

Sidestream smoke is the smoke given off by the burning end of a cigarette or similar article between puffs. Such smoke may be objectionable to some of those near the smoker who are not smoking or who do not smoke. Therefore, cigarettes that produce less sidestream smoke are highly desirable. Several attempts have been made to reduce sidestream smoke through the use of various compounds as fillers for smoking article wrapper. For example, magnesium hydroxide and magnesium oxide have been reported to reduce sidestream smoke in cigarettes. See, e.g., U.S. Pat. Nos. 4,941,485, 4,915,118, 4,881,557, 4,433,697, and 4,231,377, which are incorporated by reference.

But some smokers find that cigarettes made with wrappers containing these compounds have an unacceptably poor taste.

Others have tried colloidal solutions of magnesium hydroxide, as in U.S. Pat. No. 4,450,847. While colloidal magnesium hydroxide reduces the amount of sidestream smoke, its incorporation into smoking article wrappers also often results in a cigarette with unacceptably poor taste. Some have used physical mixtures of magnesium hydroxide or an unspecified "magnesium carbonate" composition with other compounds such as calcium carbonate in smoking article wrappers without solving the poor taste problem. See, e.g., U.S. Pat. No. 4,984,589.

Others have tried various grades of commercial basic magnesium carbonate, the standard industrial name for hydromagnesite, $Mg_5(CO_3)_4(OH)_24(H_2O)$, as an inorganic filler in cigarette papers to produce cigarettes having reduced sidestream smoke. An example of this is U.S. Pat. No. 5,121,759, which is also incorporated herein by reference. However, no teaching or disclosure of particle size or morphology of the basic magnesium carbonates used is found to guide one of skill in the art.

Generally, commercial basic magnesium carbonate (hydromagnesite) was reported many years ago for the manufacture of cigarette papers resulting in cigarettes with improved ash characteristics. See *Papeterie.* 1920, 42, 1021–1, 1065–9, and 1114–8; *Chem. Abstr.* 15, $1074^4$.

Some have even tried flavoring agents to mask the poor taste. However, none of these attempts to reduce the amount of sidestream smoke while maintaining positive subjective taste attributes have met with success.

The preparative chemistry and stability/reactivity of magnesium oxide, magnesium hydroxide, and the various carbonates of magnesium is very rich and very complicated in terms of stability fields and their characteristics of chemical transformations. As is the case for chemistry in general, a particular reaction can result in the formation of either the thermodynamically stable product(s), or kinetically controlled product(s), or various mixtures of products. In addition, solid products can be obtained in various particle sizes and morphologies.

The chemistry described herein is complicated because one must consider all of the following: kinetic and thermodynamic stability; stability fields in terms of temperature, pressure, and concentration of materials; heterogeneous reaction conditions, which impact the formation and location of nucleation sites and crystallization characteristics; and the like.

Many reports can be cited in which basic magnesium carbonate hydromagnesite $Mg_5(CO_3)_4(OH)2.4H_2O$ has been the synthetic goal. For instance, U.S. Pat. Nos. 1,361,324 and 935,418, and British Patent Nos. 548,197 and 544,907 generically describe the formation of aqueous solutions of magnesium bicarbonate (typically described as "$Mg(HCO_3)_2$"), typically incorporating a carbonation step, and then transformed by the action of a base, e.g., magnesium hydroxide, to form basic magnesium carbonate.

However, none of these attempts teach or disclose the formation of compositions containing both hydromagnesite and magnesium hydroxide. In addition, none of these attempts specified examining various reaction conditions and varying molar ratios of carbon dioxide and other starting materials to form specific compositions containing both hydromagnesite and magnesium hydroxide. In addition, none of these attempts described any effort to modify morphology and obtain materials having specific particle sizes and agglomerate sizes.

The need therefore remained for novel fillers having reduced sidestream smoke without adversely affecting the consumer's subjective taste perception of the cigarettes, such as an alternative disclosed in U.S. Pat. No. 5,228,463, assigned to the assignee of the present invention.

OBJECTS OF THE INVENTION

It is therefore an object of this invention to prepare compositions containing both hydromagnesite and magnesium hydroxide, in particular particle size ranges and morphologies, which are different from simple physical mixtures of hydromagnesite and magnesium hydroxide.

Another object of this invention is to develop reaction conditions which will allow for the preparation of specific compositions containing both hydromagnesite and magnesium hydroxide.

Another object of this invention is to provide aggregates or slurries of a broad range of compositions comprising an intimate synthetic composition of hydromagnesite and brucite (crystalline magnesium hydroxide).

An object of this invention is to obtain compositions of the materials prepared, having specific particle sizes and morphologies which render the maximum sidestream reduction without adversely affecting subjective taste perception.

Another object of the present invention is to provide processes for the synthesis of compositions of hydromagnesite and magnesium hydroxide that are useful as fillers for the fabrication of cigarette papers.

Another object of this invention to provide a smoking article wrapper designed to reduce sidestream smoke without adversely affecting the consumer's subjective taste perception of the smoking article.

SUMMARY OF THE INVENTION

A primary aspect of the present invention involves a process for preparing an inorganic magnesium composition comprising mixing magnesium hydroxide with water to form a suspension; reacting the suspension with carbon dioxide; adding an aqueous basic solution to form a mixture; and heating the mixture to form or ripen a precipitate.

In a more preferred aspect of the present invention, a process is provided for preparing an inorganic magnesium composition comprising hydromagnesite and magnesium hydroxide, the process comprising the steps of forming a solution of magnesium bicarbonate by mixing magnesium hydroxide, magnesium oxide, or a combination thereof with water to form a suspension and reacting the suspension with carbon dioxide; or by reacting an aqueous suspension or solution of at least one magnesium carbonate selected from the group consisting of hydromagnesite, nesquehonite, lansfordite, dypingite, and giorgiosite, with carbon dioxide; or reacting a magnesium salt with an alkali metal bicarbonate; forming an aqueous basic solution or a suspension of magnesium hydroxide; and mixing the solution of magnesium bicarbonate and basic solution or suspension of magnesium hydroxide and heating the resulting mixture to form a precipitate.

This invention also encompasses the novel hydromagnesite and magnesium hydroxide composition created by this process.

These and other objects, aspects, and advantages of the present invention will become apparent from the following description.

DETAILED DESCRIPTION OF THE PREFERRED EMBODIMENTS

Figure 1:
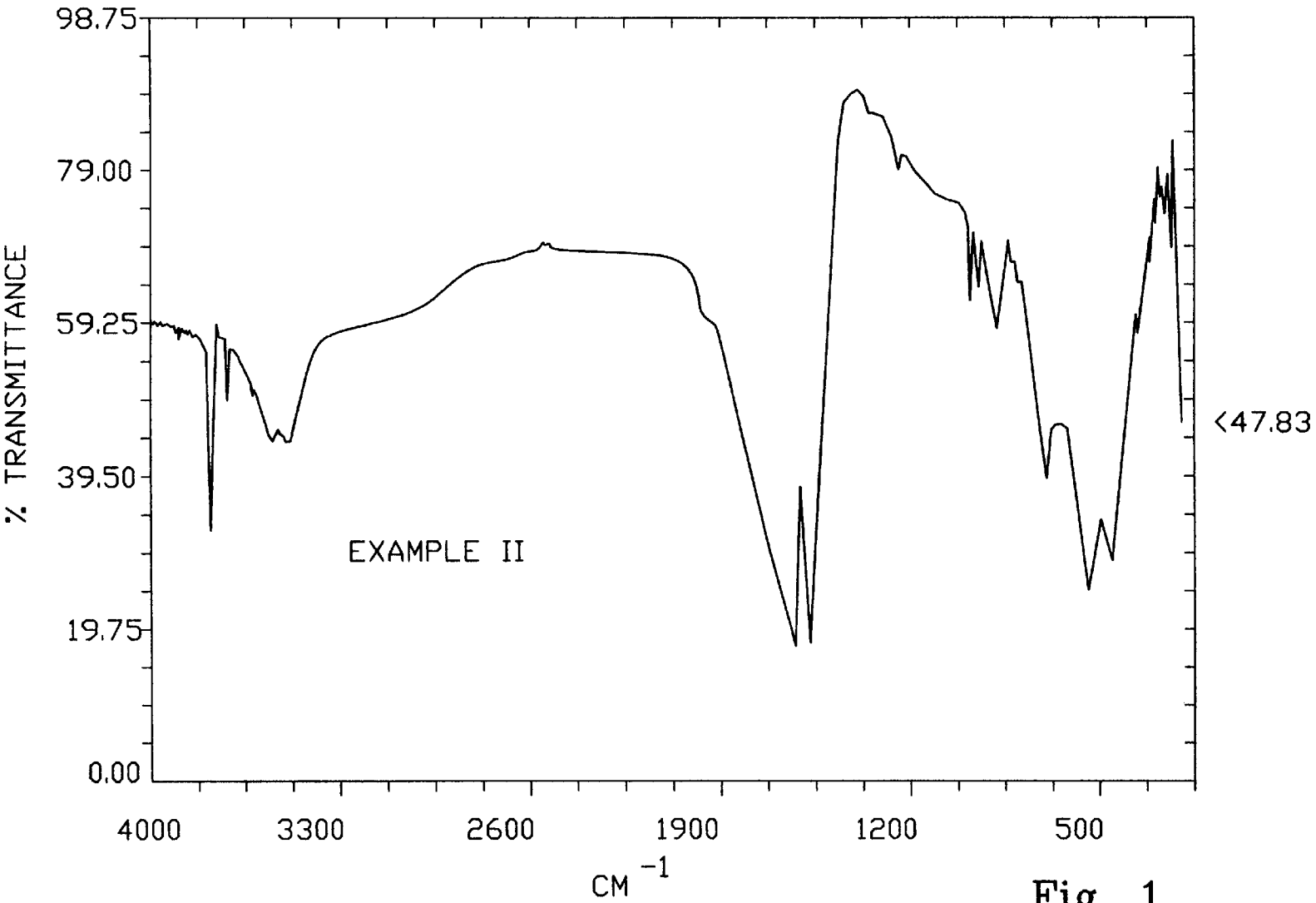
FIG. 1 is an infrared analysis plot for the material produced in Example II.
Figure 2A:
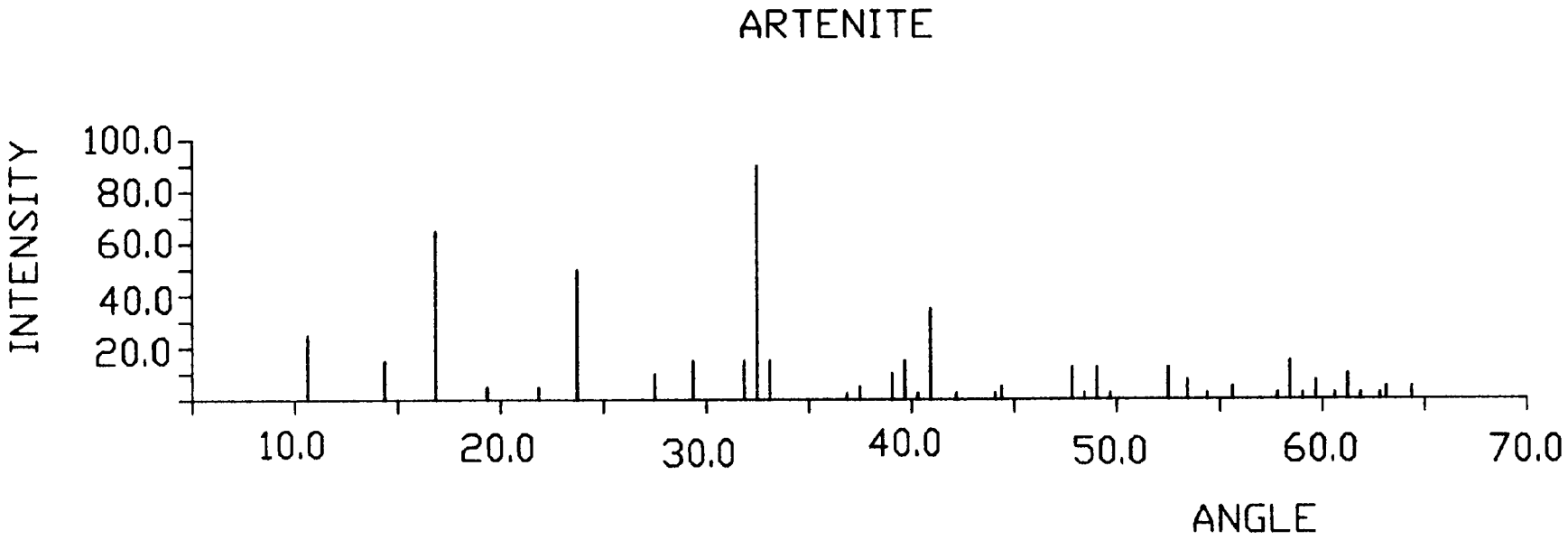
FIG. 2A is an X-ray powder diffraction pattern for artinite.
Figure 2B:
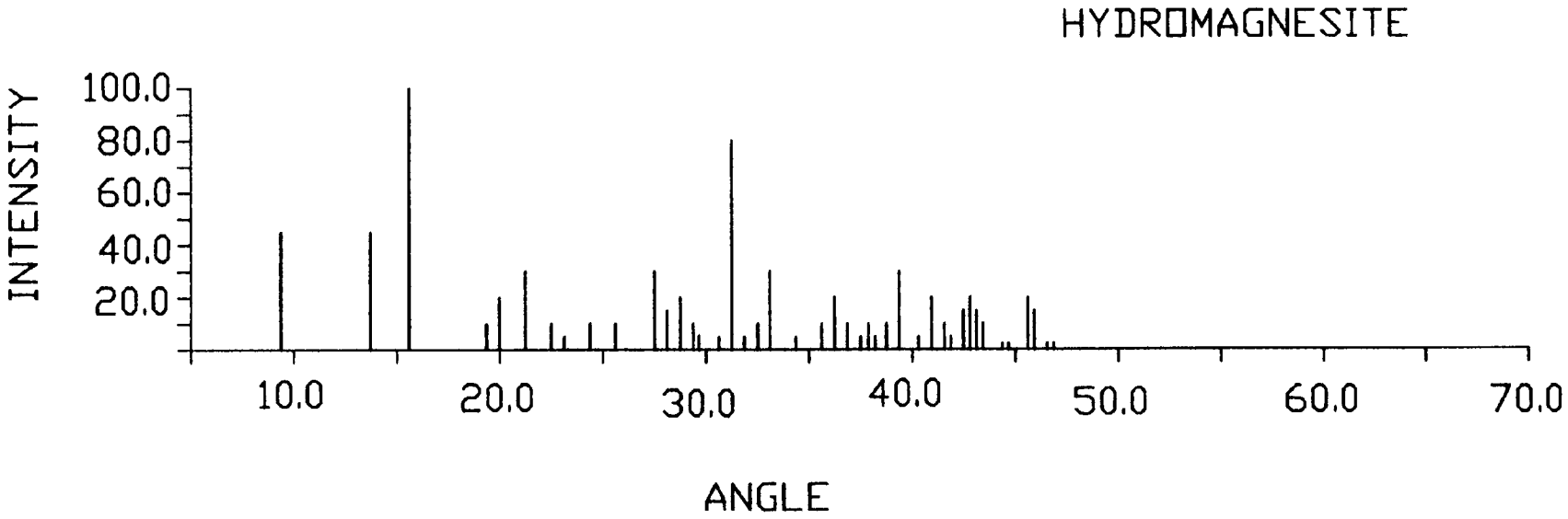
FIG. 2B is an X-ray powder diffraction pattern for hydromagnesite ($Mg_5(CO_3)_4(OH)_2.4(H_2O)$)
Figure 2C:
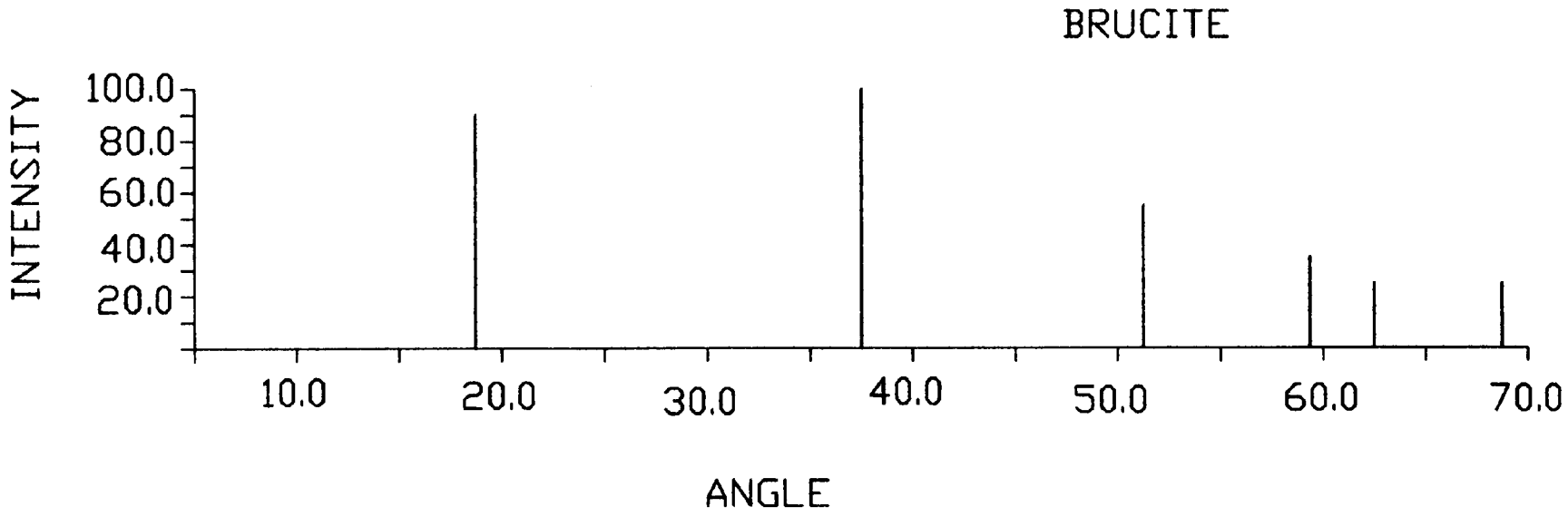
FIG. 2C is an X-ray powder diffraction pattern for brucite ($Mg(OH)_2$)

The present invention provides novel compositions which may be used as fillers for smoking article wrappers for tobacco-containing products. As used herein, the term tobacco includes not only cut tobacco leaf filler usually found in cigarettes, but also includes expanded tobacco, extruded tobacco, reconstituted tobacco, tobacco stems, tobacco substitutes, and synthetic tobacco, and blends thereof. A tobacco rod includes any substantially cylindrical or oval, tobacco-containing smoking article, e.g., a cigarette.

Generally accepted and established theories on the specific mechanisms involved in the control of sidestream smoke by components of the paper wrappers are lacking. After extensive experimentation, it is apparent that the physical and chemical properties of the particles used as filler in the paper play an important yet undefined role in the kinetics of the processes taking place. Thus, the possibility of controlling the composition and morphological features of the filler phases by appropriate discovery of reaction conditions involved in their preparation is of paramount importance. There is no successful uniform, known predictive relationship between sidestream smoke reduction and chemical or physical compositions.

Applicants have discovered unexpectedly suitable filler materials for low sidestream paper wrappers. Particularly outstanding among these are intimate or intergrown compositions of hydromagnesite with variable quantities of magnesium hydroxide produced by the synthetic techniques of this invention. The structure of these compositions is distinguishable from pure physical mixtures when viewed under scanning electron microscopy, lacking the clear crystal structures and distinguishing features of each individual component.

For a discussion of the different isolated, pure forms of magnesium carbonates, reference should be made to commonly-owned U.S. Pat. No. 5,228,463, issued Oct. 20, 1993, which is incorporated herein by reference.

The inorganic magnesium compositions of the present invention consist of hydromagnesite, having the general chemical composition $Mg_5(CO_3)_4(OH)_2.4H_2O$ as a distinct entity, with magnesium hydroxide. The compositions are preferably prepared by heating a mixture consisting of: (1) a clear to slightly cloudy solution formed by the reaction of magnesium hydroxide in water with carbon dioxide, and (2) a slurry in water of magnesium hydroxide, which may be a commercial paste consisting of small particle size (0.1–0.0 $\mu$m) magnesium hydroxide or which may be produced from the reaction of a magnesium salt such as magnesium chloride hexahydrate in water with an aqueous solution of a base such as potassium hydroxide, sodium hydroxide or ammonium hydroxide.

Heating on a bench scale is accomplished by placing the reaction mixture into a microwave oven at a full power setting for a short period of time (heating rate at 10° C. per minute) or by placing the reaction mixture into a container fitted with a heating coil at a power output of 55 Watts (heating at 1° C. per minute) or by any other applicable method such as external application of heat from a heating mantle. Heating may be accomplished on larger scales by methods and apparatus that would be easily evident to one of ordinary skill in the art in view of the teachings herein.

Alternatively, the clear to slightly cloudy solution of magnesium bicarbonate referred to in (1) above may be prepared by treating, with carbon dioxide, aqueous mixtures of magnesium oxide, or a number of the various "magnesium carbonates" such as nesquehonite, lansfordite, dypingite, giorgiosite, and/or hydromagnesite, alone or in combinations with each other or magnesium hydroxide. Alternatively, the solution can be prepared by treating a magnesium salt, e.g., magnesium chloride, with an alkali metal carbonate or bicarbonate, e.g., potassium carbonate or potassium bicarbonate, in aqueous medium. For the methods of preparing magnesium bicarbonate which involve reaction with carbon dioxide, the reaction preferably takes place at from about 14 to about 600 pounds per square inch absolute pressure [psia].

Materials produced by the procedures described herein have a specific yet broad range of compositions and particle sizes or morphologies and have proven to be more advantageous for use as fillers for the fabrication of low sidestream papers than commercially available hydromagnesite or magnesium hydroxide or physical mixtures thereof. In particular, the compositions are rosette in morphology, having aggregate sizes in the 5–20 $\mu$m range. Papers containing the materials of this invention are not only more effective in reducing sidestream smoke than commercially available hydromagnesite or magnesium hydroxide or physical mixtures of these materials, but result also in smoking articles with acceptable subjective and ash appearance.

This invention also comprises a novel means of producing intimate compositions of hydromagnesite and magnesium hydroxide in a range of compositions and specific range of particle sizes for use as fillers in low sidestream cigarette paper. The materials of the present invention are produced by solution and solid state chemical techniques. These entail preparing a solution, which may be clear to slightly cloudy, of magnesium bicarbonate, in any number of ways. For example, the reaction of magnesium hydroxide in water with $CO_2$ gas at ambient conditions will form this solution.

Alternatively, an appropriately selected carbonate of magnesium can be reacted in water with carbon dioxide gas, or a magnesium salt, e.g., magnesium chloride, can be treated with a carbonate, e.g., potassium bicarbonate. The magnesium bicarbonate solution is then admixed with a magnesium hydroxide slurry, which may be produced by the reaction of a magnesium salt, such as magnesium chloride, in water with an aqueous solution of a base, such as potassium hydroxide. The mixture is heated to a boil. If the magnesium chloride is used, the precipitate is washed several times with water until it is free of residual chloride.

Alternatively, a commercial slurry of magnesium hydroxide may be dispersed in water and used. The admixture of the two solutions can be achieved by addition of either of the solutions to the other or simultaneously to a third vessel, but preferably by adding the magnesium bicarbonate solution to the slurry of the magnesium hydroxide.

The particles produced by this process may be incorporated as the sole filler or may be admixed with other metal oxides or carbonates, such as magnesium or calcium carbonate, and used as a mixed filler in the fabrication of cigarette paper. These papers provide a very effective means of reducing sidestream smoke in cigarettes prepared therefrom and have no adverse effect on the taste subjective or ash appearance of the cigarettes.

In the examples which follow, carbon dioxide gas was bubbled through a suspension of either freshly precipitated or commercial grade magnesium hydroxide powder or paste in water to produce a solution of magnesium bicarbonate. This solution, which may be clear to slightly cloudy, then may be heated to precipitate hydromagnesite. Compositions of hydromagnesite and magnesium hydroxide may be produced by addition of dispersed magnesium hydroxide paste to the magnesium bicarbonate solution and the thoroughly mixed suspension heated to effect coprecipitation of hydromagnesite and magnesium hydroxide.

Alternately, in a separate container, magnesium hydroxide may be freshly prepared by treating an aqueous solution of magnesium chloride with a base, such as potassium hydroxide. The strongly basic suspension containing the magnesium hydroxide then may be mixed with the magnesium bicarbonate solution and the mixture is heated to produce a copious amount of precipitate. The resultant precipitate may be washed with water several times by decantation until free of chloride when tested with silver nitrate. Aliquots of the slurried particles may be dried at about 100° C. overnight, to obtain solids for characterization. Alternatively, such may be allowed to dry out at room temperature over a period of days or weeks.

The products described herein were examined by thermogravimetric analysis, infrared spectroscopy, and X-ray analysis for compositional characterization and light microscopy for morphology and particle size determination. These techniques showed the products to consist of compositions of hydromagnesite and magnesium hydroxide. The proportions of these two materials in the final product are controlled by the experimental conditions, e.g., relative amounts of magnesium hydroxide used in each step of the reaction. Preferably, the compositions will contain from about 99% to about 10% hydromagnesite. Most preferably, the compositions will contain from about 95% to about 40% hydromagnesite.

The use of these hydromagnesite/magnesium hydroxide compositions as fillers in cigarette papers results in the reduction of sidestream smoke while maintaining subjective acceptability. These materials, by themselves or when admixed with calcium carbonate and used as paper fillers, produced cigarettes which exhibited a reduction in sidestream smoke of as much as 82% when compared to a standard cigarette, and were otherwise similar to standard cigarettes in burn-rate, ash appearance, and smoke taste qualities.

To prepare wrappers containing the fillers of the present invention, conventional cigarette papermaking procedures are used with the substitution of the hydromagnesite/magnesium hydroxide compositions and calcium carbonate for the conventional calcium carbonate filler. The paper wrappers may be made from flax, wood pulp, and other plant fibers. In addition, the paper wrappers may be a conventional one wrapper construction, a multiwrapped construction or a multilayer single wrap construction.

When used as filler in the fabrication of wrappers for smoking articles, an amount equal to about 5% to about 45% of the final wrapper weight should be used, preferably about 10% to about 35% by weight. Sizing agents such as alkali metal salts of carboxylic acids are preferably added at an amount equal to between about 2 to about 15% by weight of the wrapper with the preferred salts being potassium citrate and potassium succinate.

The wrappers containing the fillers of the present invention have a basis weight of between about 25 to about 75 grams per square meter and have a porosity of between about 2 to about 15 cubic centimeters per minute per square centimeter as measured by the CORESTA method ("CORESTA units"). The most preferred basis weight is between about 35 to about 65 grams per square meter and the most preferred porosity is between about 4 and about 8 CORESTA units.

In the practice of this invention the synthetic inorganic magnesium compositions may be used alone or preferably may be mixed with other fillers with minimal effect on the sidestream smoke reduction. In the case of mixtures, preferably at least 40% by weight of the resulting filler should be the synthetic hydromagnesite/magnesium hydroxide composition(s) of the present invention. The balance of the filler, preferably up to 60% by weight, may comprise one or more of compounds of inorganic oxides or inorganic carbonates. These compounds can include magnesium oxide, magnesite, hydromagnesite, calcium carbonate, and titanium dioxide as well as other fillers known in the art.

In a preferred embodiment, sizing agents, such as alkali metal salts of carboxylic acids or phosphoric acid, are used to adjust or control the burn rate of the resulting smoking article. Particularly good sizing agents include sodium fumarate, sodium citrate, and potassium salts namely potassium citrate and potassium succinate, as well as monopotassium phosphate. Of these, potassium citrate and potassium succinate are preferred.

The following examples demonstrate the practical and beneficial results of this invention and should be read as illustrations of, rather than limitations on, the present invention.

EXAMPLES

In the examples which follow, samples of the products recovered were dried in an oven at about 105° C. for 5 to 6 hours. The dried samples were then characterized as follows:

Infrared analyses were performed by using a Bohem Michelson-102 FT-IR with an instrument resolution of 4.00 $cm^{-1}$. The FT-IR spectra were taken using CsI (Cesium Iodide) pellets. The spectra were composites of 128 individual scans and were all taken under a dry nitrogen atmosphere at room temperature. The dried powders were analyzed by X-ray diffraction using a Phillips XRD 3100 diffractometer.

Thermogravimetric analyses (TGA) were performed by placing approximately 5 mg of the dried sample in a Stanton Redcroft TG 760 Thermobalance, Model 761. The samples were heated to approximately 950° C. at a rate of 20° C./min in air at a flow rate of 40 cc/min.

Example I

A sample of 10 g of magnesium hydroxide obtained from Aldrich Chemical Co. was suspended in 50 mL of 0.06 M potassium hydroxide solution. The suspension was placed into a high pressure reactor and exposed to $CO_2$ gas at 440 psi to obtain a solution. This solution was then placed into a microwave oven and heated at high power setting for 10 minutes to obtain a precipitate. The precipitate was recovered by filtration and washed several times with water. The precipitate was kept as a moist paste, containing about 35 to 40% water, until used to make paper. An aliquot of the precipitate was dried in air at room temperature to obtain a dried powder for analytical characterization. An X-ray analysis showed the sample to consist mostly of hydromagnesite with a minor percentage of magnesium hydroxide. TGA confirmed these results.

Example II

The material of this example was prepared by the following procedure: (1) To 800 mL of water in a 1-Liter Erlenmeyer flask, fitted with a drop tube and a magnetic stirrer, were added 12.3 g (0.21 moles) of magnesium hydroxide obtained from Aldrich Chemical Co. A stream of $CO_2$ gas was bubbled through the stirred slurry until a slightly cloudy solution resulted. (2) Separately a solution was prepared using 128.4 g (0.63 moles) of magnesium chloride hexahydrate in 100 mL of water.

To this solution were added 253 mL of 5 M potassium hydroxide solution to precipitate magnesium hydroxide. (3) To the 800 mL solution prepared in step 1 was added the entire suspension of step 2, and the combined slurry was mixed thoroughly. This mixture was then heated in a microwave oven to a boil. (4) The precipitate prepared in step 3 was washed several times, using 3–4 Liters of water each time. The aqueous washes were removed each time by decantation.

Washing was continued until the washes were free of chloride. Tests for chloride were made on the decantates by acidifying with acetic acid and testing with silver nitrate solution. The precipitate was kept as a slurry in water until used to make paper. Aliquots of the precipitate were evaporated to dryness in air at room temperature for solids determination and analytical characterization of the product.

Figure 3:
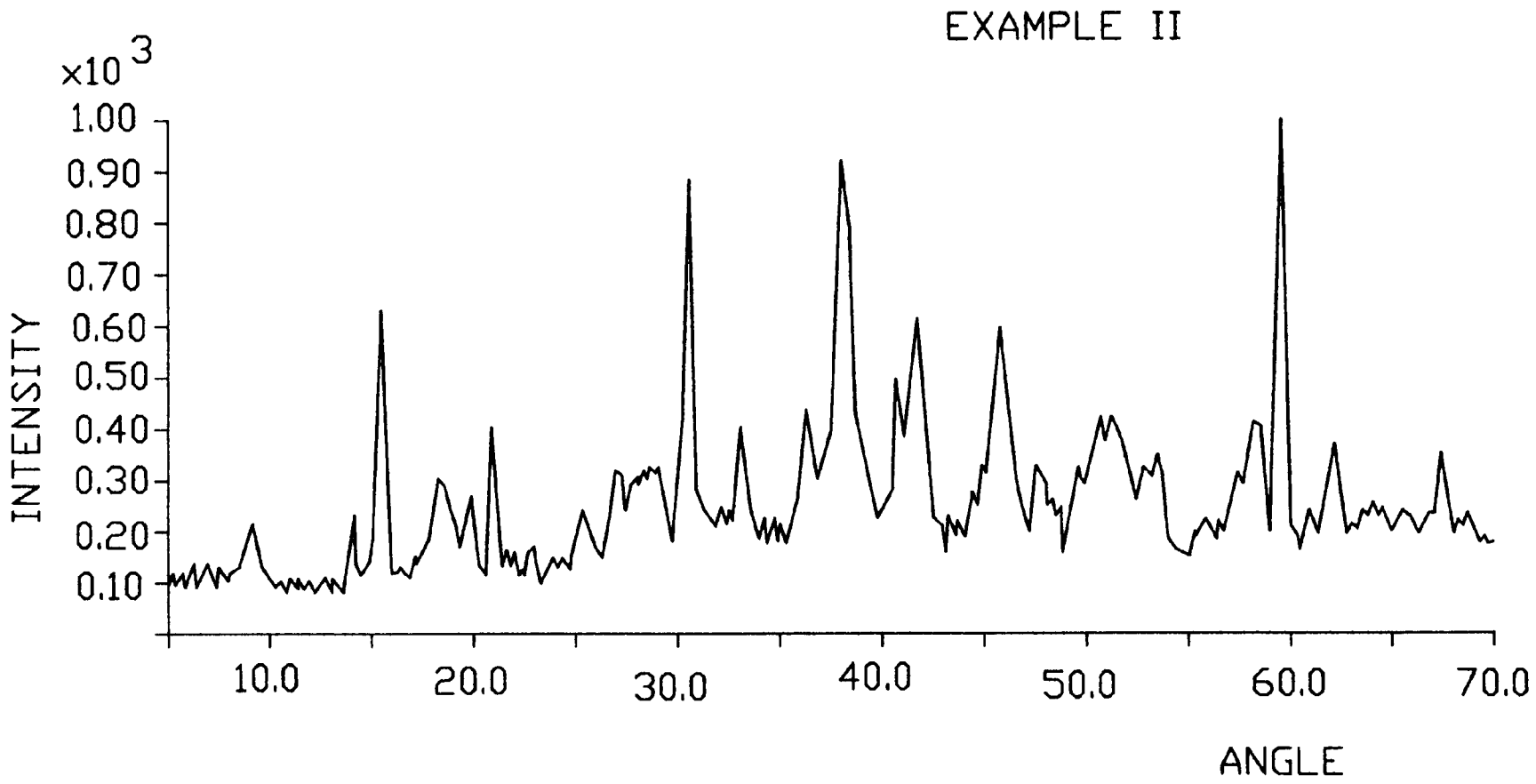
FIG. 3 is an X-ray powder diffraction pattern for the material produced in Example II.

The infrared spectrum (FIG. 1) showed the material to be a composition of hydromagnesite and magnesium hydroxide ($Mg(OH)_2$). X-ray analysis (FIG. 3) confirmed this result. TGA indicated the material to be a composition consisting of approximately 65% hydromagnesite and 35% magnesium hydroxide.

Example III

A solution was prepared using 102.9 g (0.51 moles) of magnesium chloride hexahydrate in 100 mL of water. To this solution were added 203 mL of 5 M potassium hydroxide solution to obtain a slurry containing a white precipitate. This slurry was then added to 800 mL of a solution of solubilized magnesium hydroxide, prepared as described in step 1 of Example II, with thorough mixing. The resultant slurry was then heated to a boil for 25 minutes. After cooling, the precipitate was recovered by decantation and washed several times with water until the washes were free of chloride. The washed precipitate was kept as a slurry in water until used for papermaking. An aliquot of this slurry was evaporated to dryness at 105° C. for solids determination and analytical characterization of the product.

The infrared and X-ray analyses showed the product to consist of a composition of hydromagnesite and magnesium hydroxide. TGA indicated this material to be a composition consisting of approximately 81% hydromagnesite and 19% magnesium hydroxide.

Example IV (1) To 800 mL of water in a one-Liter Erlenmeyer flask, fitted with a drop tube and a magnetic stirrer, were added 12.3 g (0.21 moles) of magnesium hydroxide obtained from Aldrich Chemical Co. A stream of $CO_2$ gas was bubbled through the stirred slurry until a slightly cloudy solution resulted. The use of a more highly purified starting material yields a clear solution. (2) Separately, a solution was prepared using 86.1 g (0.42 moles) of magnesium chloride hexahydrate in 100 mL of water. To this solution were added 170 mL of 5 M potassium hydroxide solution to obtain a white precipitate. (3) To a 400 mL aliquot of the solution prepared in step 1 was added the entire suspension of step 2, and the combined slurry was mixed thoroughly.

This mixture was then rapidly brought to a boil at a heating rate of 10° C. per minute where it was kept for 30 minutes. (4) The precipitate prepared in step 3 was recovered by decantation and washed several times with water. The aqueous washes were removed each time by decantation. Washing was continued until the washes were free of chloride. The precipitate was kept as a slurry in water until used for papermaking. An aliquot of the slurry was evaporated to dryness at about 105° C. for solids determination and analytical characterization of the product.

The infrared and X-ray analyses showed the product to consist of a composition of hydromagnesite and magnesium hydroxide. TGA indicated the material to be a composition consisting of approximately 51% hydromagnesite and 49% magnesium hydroxide.

Example V (1) A slightly cloudy solution, containing 12.3 g (0.21 moles) of magnesium hydroxide obtained from Aldrich Chemical Co. in 800 mL of water was prepared as described in step 1 of Example IV. (2) Separately a solution was prepared using 128.4 g (0.42 moles) of magnesium chloride hexahydrate in 100 mL of water. To this solution were added 253 mL of 5 M potassium hydroxide solution to obtain a white precipitate. (3) To the 800 mL solution prepared in step 1 was added the entire suspension of step 2, and the combined slurry was mixed thoroughly. (4) An aliquot of 100 mL of the slurry of step 3 was poured onto a preheated stainless steel pan with heating continued to evaporate the water. When splattering occurred, there was added 20–30 mL of water to the pan and heating was continued until the sample was dry.

The dried sample was then transferred into a clean 4-Liter beaker. This procedure was repeated until the supply of the slurry was exhausted. The combined dried sample was then washed several times with water, removing the aqueous layer each time by decantation. Washing was continued until the washes were free of chloride. The precipitate was kept as a slurry in water until used for papermaking. An aliquot of the slurry was evaporated to dryness at 100° C. for solids determination and analytical characterization of the product.

Infrared and X-ray analyses showed the product to consist of a composition of hydromagnesite and magnesium hydroxide. TGA indicated the composition to consist of approximately 54% hydromagnesite and 46% magnesium hydroxide.

Example VI

The procedure described in Example V was repeated, with the exception that in step 2 there were used 102.9 g (0.51 moles) of magnesium chloride hexahydrate and 203 mL of 5 M potassium hydroxide solution. The combined slurry of step 3 was then worked up in a manner similar to that of step 4 of Example V.

The final product from this preparation was a precipitate also with a very small particle size, as evidenced by microscopic examination, and was shown to be a composition of hydromagnesite and magnesium hydroxide by infrared and X-ray analyses. TGA showed the composition of the product to be 66% hydromagnesite and 34% magnesium hydroxide.

Example VII

The procedure described in Example IV was repeated in its entirety. The material produced in this replicated preparation was indistinguishable from that produced in Example IV by X-ray and SEM. TGA analysis showed the product from this replication to consist of 50% hydromagnesite and 50% magnesium hydroxide.

Example VIII (1) To 400 mL of distilled water in a 600-mL beaker, fitted with a drop tube and a magnetic stirrer, were added 18.1 g (0.105 moles) of magnesium hydroxide paste obtained from Reheis Inc., approximately 34% solids. The mixture was agitated with a magnetic stirrer to form a well-dispersed slurry, having a pH of 9.97. An ice bath was then used to cool the slurry while $CO_2$ gas was bubbled through it with continued stirring. After about 2 hours, the magnesium hydroxide dissolved to provide a nearly clear solution having a pH of 7.06.

(2) In a separate 1000-mL beaker, containing 270 mL of water, were added 72.7 g (0.42 moles) of the Reheis magnesium hydroxide paste. The mixture was agitated with a magnetic stirrer to form a well dispersed slurry.

(3) The solution prepared as described in step 1 was added slowly, about 100 mL/min., to the slurry of step 2 with stirring. After the addition was completed, the mixture was stirred for one additional hour. The pH of the resultant mixture was 9.56.

(4) The mixture of step 3 was placed into a standard metallic pan and a heating coil was used to raise the temperature of the mixture, which was being stirred continuously, to 90° C.±2° C. at a rate of 1° C./min. using a power output of 50 Watts. The temperature of the mixture was maintained for one hour, after which time it was allowed to cool down to room temperature with continued stirring. The pH of the finished slurry was 9.76. The product was kept as a slurry in water until used for papermaking. An aliquot of the slurry was evaporated to dryness at 105° C. for solids determination and analytical characterization of the product.

Figure 4:
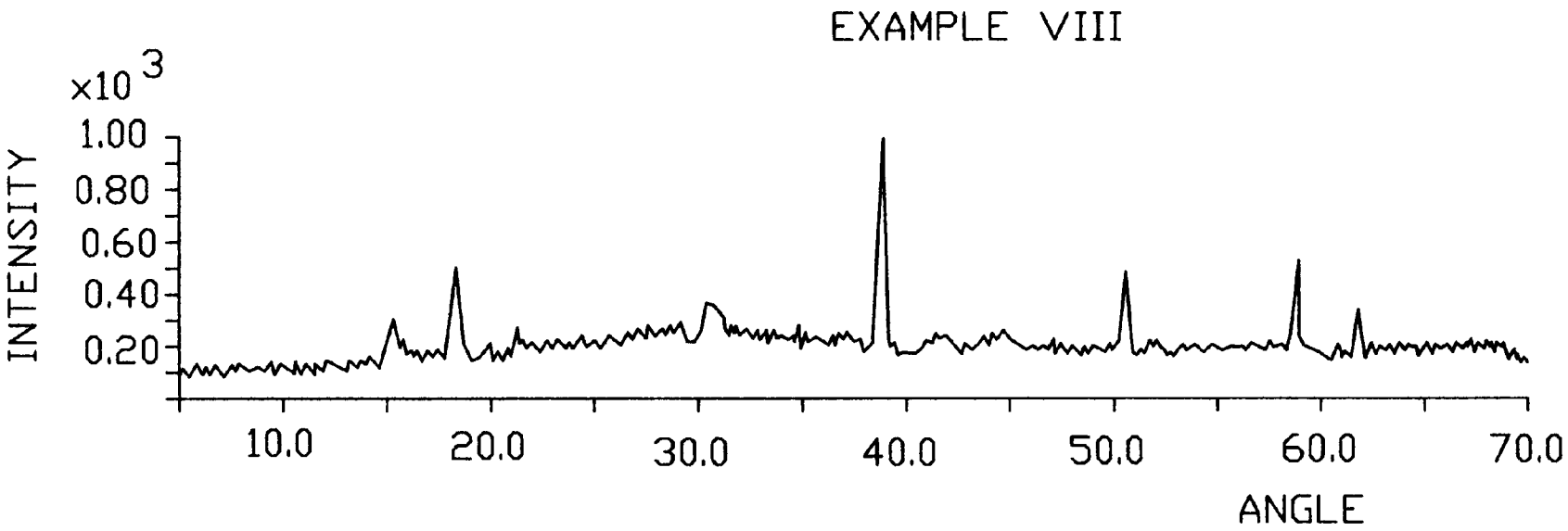
FIG. 4 is an X-ray powder diffraction pattern for the material produced in Example VIII.
Figure 5:
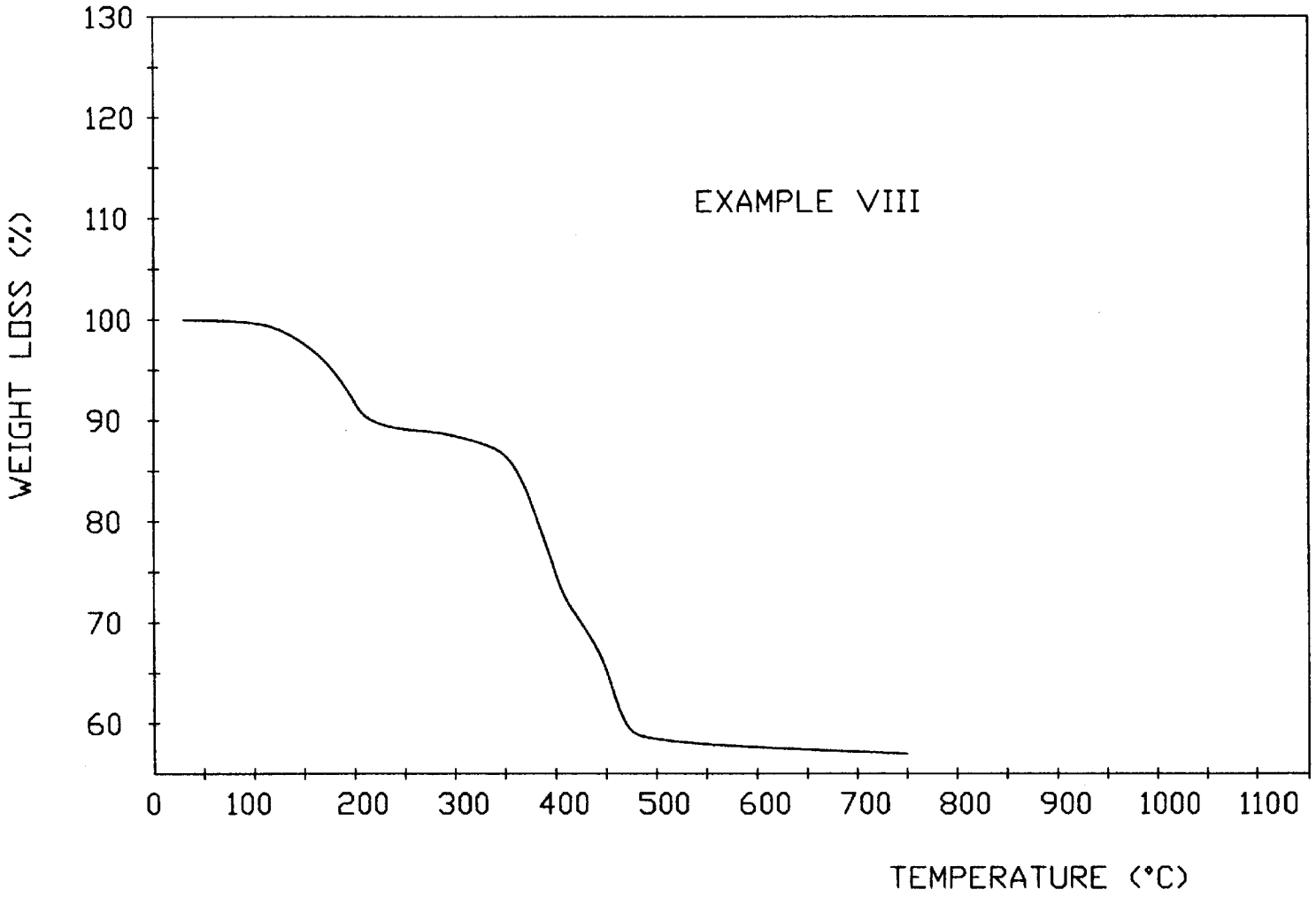
FIG. 5 is a thermal decomposition plot for the material produced in Example VIII, having a sample size of 4.87 mg and a residue in air at 750 degrees celsius of 55.97%, or 2.72 mg.
Figure 7:
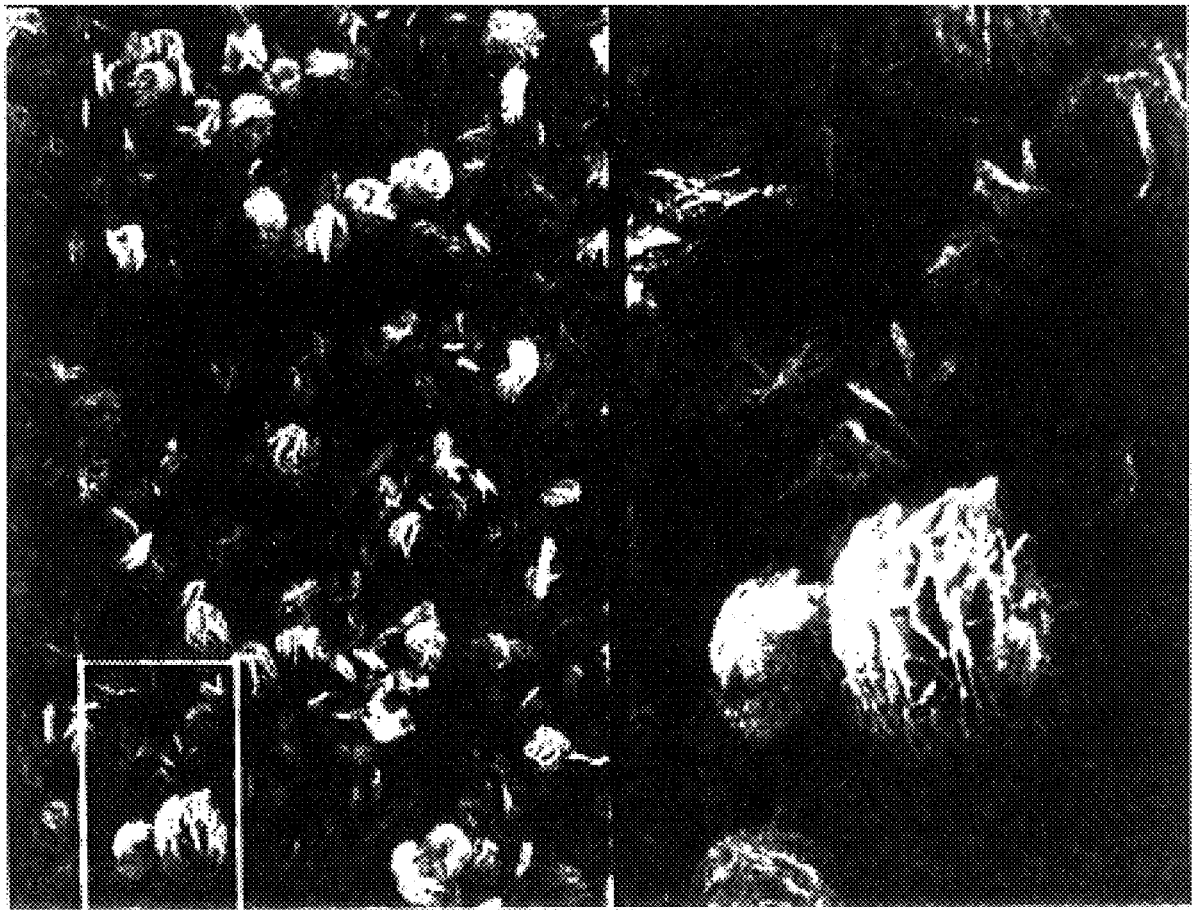
FIG. 7 is a scanning electron microphotograph of the material produced in Example VIII illustrating a unique, rosette-type structure.

X-ray analysis (FIG. 4) and FT-IR showed the product to consist of a composition of hydromagnesite and magnesium hydroxide. TGA (FIG. 5) of an original sample size of 4.87 mg, leaving a residue of 55.97% in air (2.72 mg) indicated the composition to consist of 51% hydromagnesite and 49% magnesium hydroxide. A "rosette" morphology, characteristic of the intimate hydromagnesite/magnesium hydroxide compositions of this invention, is shown by SEM (FIG. 7) of the product. The sample visually appears to be homogeneous, i.e., no individual hexagonal platelets of brucite are observed.

Example IX (1) To 400 mL of distilled water in a 600-mL beaker, fitted with a drop tube and a magnetic stirrer, were added 18.1 g (0.105 moles) of magnesium hydroxide paste obtained from Reheis Inc., approximately 34% solids. The mixture was agitated with a magnetic stirrer to form a well-dispersed slurry, having a pH of 9.97. An ice bath was then used to cool the slurry while $CO_2$ gas was bubbled through it with continued stirring. After about 2 hours, the magnesium hydroxide solubilized to provide a nearly clear solution having a pH of 7.02.

(2) A solution was prepared by dissolving 86.1 g (0.423 moles) of magnesium chloride hexahydrate, obtained from Spectrum Chemical, in 100 mL of distilled water in an 800-mL beaker. The pH of the solution was 5.72. To this solution was added 170 mL of 5 M potassium hydroxide to precipitate magnesium hydroxide. The freshly precipitated magnesium hydroxide was recovered by filtration under vacuum using a filter cloth. The moist precipitate was then washed with water several times by making a dispersion in water and filtering until the filtrates tested free of chloride.

(3) The solution prepared as described in step 1 was added slowly, about 100 mL/min., to a slurry of the material obtained in step 2 with stirring. After the addition was completed, the mixture was stirred for one additional hour. The pH of the resultant mixture was 9.62.

(4) The mixture of step 3 was placed into a standard metallic pan and a heating coil was used to raise the temperature of the mixture, which was being stirred continuously, to 90° C.±2° C. at a rate of 1° C./min. using a power output of 50 Watts. The temperature of the mixture was maintained at 90° C.±2° C. for one hour, after which time it was allowed to cool down to room temperature with continued stirring. The pH of the finished slurry was 9.32. The product was kept as a slurry in water until used for papermaking. An aliquot of the slurry was evaporated to dryness at about 105° C. for solids determination and analytical characterization of the product.

Figure 6:
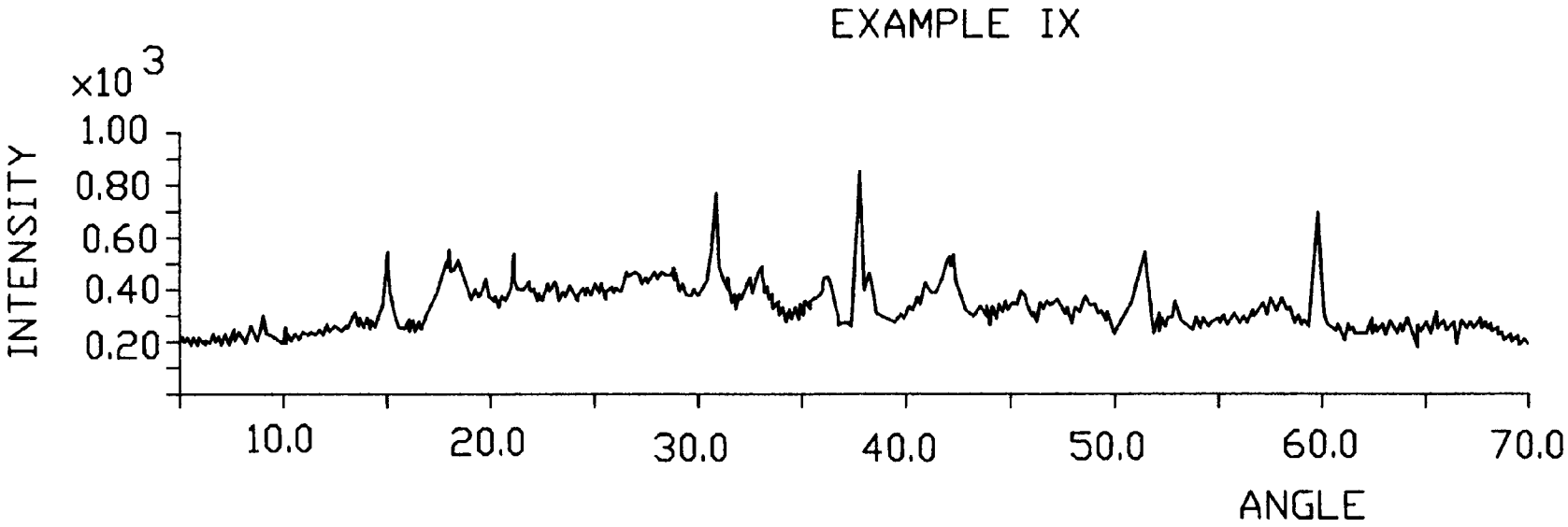
FIG. 6 is an X-ray powder diffraction pattern for the material produced in Example IX.

X-ray (FIG. 6) and FT-IR analyses showed the product to consist of a composition of hydromagnesite and magnesium hydroxide. TGA indicated the composition to consist of 61% hydromagnesite and 39% magnesium hydroxide in rosette morphology (5–10 $\mu$m).

Example X

To 5640 mL of water in a 12-liter round-bottom flask were added 274.1 g magnesium hydroxide paste obtained from Barcroft (31.5% solids). The stirred slurry was cooled to 3 C or less, in an ice-bath while $CO_2$ gas was being spared into the stirred, ice-cooled slurry. After 70 minutes, the reaction was essentially complete, and the solution was clear. This magnesium bicarbonate solution, freshly saturated with carbon dioxide at 3° C., was added to a stirred slurry containing 1103 g of Barcroft magnesium hydroxide paste, from the same lot as used previously (31.47% solids), in 3807 mL of water at room temperature over about 5 minutes. After 60 minutes of stirring at ambient temperature (16° C.–16.5° C.) heating was begun.

The temperature was increased to about 92° C. over a 3 hour period with continued stirring. The temperature was maintained at about a 90.5° C.–94.5° C. range for one hour, at which point heating and stirring were stopped. The mixture was allowed to cool undisturbed overnight. The suspension was filtered, and the solid material was washed with 4000 mL of water. The resulting paste weighed 3676 g. A sample was dried at about 105° C. TGA indicated the composition to consist of 65% hydromagnesite and 35% magnesium hydroxide.

The inorganic magnesium compositions prepared as described in the above examples were used as fillers for cigarette wrappers which were in turn used to prepare a series of cigarettes. The cigarette wrappers were constructed by combining flax fibers with approximately 30% by weight of the example filler composition alone or with a mixture of the example filler composition and calcium carbonate in the proportions shown in Table I. In either case, the fiber and filler slurries were then cast on a handsheet mold to a target basis weight of 45 g/m$^2$.

After being dried, the wrappers were treated with a solution of potassium succinate, as a sizing agent, and the papers then were used to fabricate cigarettes using a commercial blend of tobaccos.

TABLE I

| Paper Sample | Weight % | Filler(s) |
|---|---|---|
| 1 | 30.0% | Example I filler |
| 2 | 15.0% | Example II filler |
| | 15.0% | calcium carbonate |
| 3 | 20.0% | Example III filler |
| | 10.0% | calcium carbonate |
| 4 | 15.0% | Example III filler |
| | 15.0% | calcium carbonate |
| 5 | 15.0% | Example IV filler |
| | 15.0% | calcium carbonate |
| 6 | 30.0% | Example V filler |
| 7 | 12.0% | Example V filler |
| | 13.8% | calcium carbonate |
| 8 | 11.5% | Example VI filler |
| | 14.0% | calcium carbonate |
| 9 | 11.5% | Example VII filler |
| | 16.0% | calcium carbonate |
| 10 | 27.6% | Example VIII filler |
| 11 | 12.4% | Example VIII filler |
| | 14.8% | calcium carbonate |
| 12 | 11.8% | Example IX filler |
| | 14.0% | calcium carbonate |
| 13 | 12.6% | Example X filler |
| | 14.2% | Multifex MM calcium carbonate |
| 14 | 13.7% | Example X filler |
| | 14.7% | Microna 3 calcium carbonate |
| 15 | 12.8% | Example X filler |
| | 15.0% | Albacar calcium carbonate |

To measure the amount of sidestream smoke generated by cigarettes as described in the foregoing examples, burning cigarettes were allowed to free burn while the sidestream smoke traveled through a photocell through which light was passed. The photocell detected the transmitted light intensity during the burning of 30 mm of the tobacco rod. The measured light intensity over the course of burning was determined and compared to the light intensity when no smoke is present in the photocell. An extinction coefficient (EC) was calculated based on the Beer-Lambert Law.

The ECs of the cigarettes containing the fillers of the present invention were compared with the EC of a control cigarette. The results are reported in Table II below as the percent reduction in the EC. The control was typically an 85 or 100 mm commercial cigarette having a 25 g/m$^2$ paper wrapper with a porosity of about 30 CORESTA units and a citrate salt of potassium and/or sodium sizing agent. Test cigarettes were made by hand at comparable packing densities using the same tobacco filler as the control. All test samples were of standard circumference (about 25 mm) and 85 to 100 mm in length including a 27 mm cellulose acetate filter.

Static Burn Time (SBT) also was measured for the cigarettes described in the foregoing. SBT is the amount of time it takes a cigarette to burn 40 mm under static conditions. In other words, it is the rate at which a cigarette smolders in the absence of drafts or puffing action. In Table II below, SBT is expressed per square meter, porosity is in CORESTA units, and sizing is in weight percent.

TABLE II

| Paper Sample | Basis Weight, g/m$^2$ | Porosity | Sizing | SBT | Extinction Coefficient | % Reduction* |
|---|---|---|---|---|---|---|
| 1 | 47.0 | 3.2 | 6.5% $K_2$ succ | 11.0 | 0.21 (0.84) | 75 |
| 2 | 45.0 | 4.4 | 6.3% $K_2$ succ | 8.5 | 0.30 (0.77) | 61 |
| 3 | 44.0 | 4.2 | 6.3% $K_2$ succ | 9.6 | 0.19 (0.76) | 75 |
| 4 | 45.6 | 4.4 | 8.5% $K_2$ succ | 7.8 | 0.35 (0.80) | 56 |
| 5 | 45.4 | 3.1 | 8.2% $K_2$ succ | 9.4 | 0.26 (0.81) | 68 |
| 6 | 45.0 | 4.1 | 8.0% $K_2$ succ | 12.2 | 0.10 (0.56) | 82 |
| 7 | 45.0 | 4.4 | 7.5% $K_2$ succ | 8.0 | 0.27 (0.69) | 61 |
| 8 | 45.0 | 4.5 | 7.8% $K_2$ succ | 7.8 | 0.30 (0.70) | 57 |
| 9 | 45.2 | 5.0 | 7.5% $K_2$ succ | 9.1 | 0.19 (0.64) | 70 |
| 10 | 45.3 | 5.1 | 6.5% $K_2$ succ | 10.7 | 0.14 (0.66) | 79 |
| 11 | 45.1 | 4.7 | 7.2% $K_2$ succ | 9.4 | 0.20 (0.66) | 70 |
| 12 | 45.6 | 5.1 | 7.0% $K_2$ succ | 9.2 | 0.19 (0.66) | 71 |
| 13 | 49.0 | 5.6 | 6.5% $K_2$ succ | 7.4 | 0.24 (0.28) | 60 |
| 14 | 49.5 | 4.6 | 5.2% $K_2$ succ | 9.0 | 0.24 (0.72) | 67 |
| 15 | 49.3 | 4.8 | 5.8% $K_2$ succ | 8.3 | 0.25 (0.70) | 64 |

*Reduction based on extinction coefficient relative to a standard commercial control, having approximately the same mainstream smoke delivery, smoked on same days as the sample. Extinction coefficients for the respective controls are shown in parentheses.

As can be seen from the above results, cigarettes made with papers containing the compositions of the present invention provide significant sidestream smoke reduction relative to control cigarettes made with standard papers containing calcium carbonate as the sole filler. It is also evident that potassium succinate is an effective fluxing agent for the papers containing the fillers of this invention. Upon subjective evaluation, the cigarettes described above, specifically those fabricated with wrappers containing fillers of the compositions of this invention blended with calcium carbonate, were judged to be comparable in smoking qualities to standard commercial cigarette products. Additionally, the quality of the ash of the cigarettes made as described above was judged quite acceptable in appearance.

One skilled in the art will appreciate that the present invention may be practiced by other than the preferred embodiments which are presented above for purposes of illustration and not limitation, and the present invention is defined by the claims that follow.

What is claimed is:

1. A paper suitable for use as a smoking article wrapper comprising:

plant fiber and filler, said filter comprising intergrown hydromagnesite and magnesium hydroxide having a rosette morphology produced by the following process:

(1) forming a first solution by one of the following steps:

(i) mixing magnesium hydroxide, magnesium oxide or a combination thereof with water to form a suspension and reacting the suspension with carbon dioxide;

(ii) reacting carbon dioxide with an aqueous suspension or solution of at least one magnesium carbonate selected from the group consisting of hydromagnesite, nesquehonite, dypingite, and giorgiosite; or (iii) reacting a magnesium salt with an alkali metal bicarbonate;

(2) forming an aqueous basic suspension of magnesium hydroxide;

(3) mixing the solution of part (1) and the aqueous basic suspension of part (2); and (4) heating the resulting mixture to form a precipitate.

2. The paper of claim 1, wherein the reaction with carbon dioxide of step (1)(i) or (ii) takes place at from about 14 to about 600 psia.

3. The paper of claim 1, wherein the magnesium salt of step (1)(iii) is magnesium chloride and the alkali metal bicarbonate is potassium bicarbonate.

4. The paper of claim 1, wherein the magnesium hydroxide of step (b)(2) is prepared by reacting magnesium chloride hexahydrate with water and an aqueous basic solution, containing at least one member selected from the group consisting of aqueous potassium hydroxide, sodium hydroxide, and ammonium hydroxide.

5. The paper of claim 1, further having a basis weight of between about 15 to about 75 grams per square meter.

6. The paper of claim 5, further having a porosity of between about 2 to about 15 CORESTA units.

7. The paper of claim 6, further comprising between about 2% to about 15% by weight of a sizing agent comprising an alkali metal salt of an acid.

8. The paper of claim 7, wherein the sizing agent is at least one member selected from the group consisting of sodium fumarate, potassium citrate, sodium citrate, potassium dihydrogen phosphate, and potassium succinate.

9. A paper suitable for use as a smoking article wrapper comprising:

(a) plant fiber;

(b) a filler comprising at least 40% of a mixture of hydromagnesite and brucite, said hydromagnesite comprising intergrown hydromagnesite and magnesium hydroxide having a rosette morphology produced by the following process:

(1) forming a first solution by one of the following steps;

(i) mixing magnesium hydroxide, magnesium oxide or a combination thereof with water to form a suspension and reacting the suspension with carbon dioxide;

(ii) reacting an aqueous suspension or solution of at least one magnesium carbonate selected from the group consisting of hydromagnesite, nesquehonite, dypingite, and giorgiosite, with carbon dioxide; or (iii) reacting a magnesium salt with an alkali metal bicarbonate;

(2) forming an aqueous basic suspension of magnesium hydroxide;

(3) mixing the solution of part (1) and the aqueous basic suspension of part (2); and (4) heating the resulting mixture to form a precipitate; and said filler further comprising up to about 60% by weight of an admixture of at least one compound selected from the group consisting of inorganic oxides and inorganic carbonates.

10. The paper of claim 9, wherein the reaction with carbon dioxide of step (b) (1) (i) or (ii) takes place at from about 14 to about 600 psia.

11. The paper of claim 9, wherein the magnesium salt of step (b)(1)(iii) is magnesium chloride and the alkali metal bicarbonate is potassium bicarbonate.

12. The paper of claim 9, wherein the magnesium hydroxide of step (b) (2) is prepared by reacting magnesium chloride hexahydrate with water and an aqueous basic solution consisting of at least one member selected from the group consisting of aqueous potassium hydroxide, sodium hydroxide, and ammonium hydroxide.

13. The paper of claim 9, wherein said admixture compound is at least one member selected from the group consisting of magnesium oxide, hydromagnesite, magnesite, calcium carbonate, and titanium dioxide.

14. The paper of claim 9, further having a basis weight of between about 15 to about 75 grams per square meter.

15. The paper of claim 14, further having a porosity of between about 2 to about 15 CORESTA units.

16. The paper of claim 15, further comprising between about 2% to about 15% by weight of a sizing agent comprising an alkali metal salt of an acid.

17. The paper of claim 16, wherein the sizing agent is at least one member selected from the group consisting of sodium fumarate, potassium citrate, sodium citrate, potassium dihydrogen phosphate, and potassium succinate.

18. A smoking article having reduced sidestream smoke comprising a tobacco rod enveloped by a paper wrapper, said paper wrapper comprising:

(a) plant fiber;

(b) between about 5% to about 45% by weight of an inorganic magnesium filler, said filler comprising a composition of intergrown hydromagnesite and brucite having a rosette morphology, said hydromagnesite comprising between about 95% to about 40% of said composition and said composition produced by the following process:

(1) forming a first solution by one of the following steps:

(i) mixing magnesium hydroxide, magnesium oxide or a combination thereof with water to form a suspension and reacting the suspension with carbon dioxide;

(ii) reacting an aqueous suspension or solution of at least one magnesium carbonate selected from the group consisting of hydromagnesite, nesquehonite, dypingite, and giorgiosite, with carbon dioxide; or (iii) reacting a magnesium salt with an alkali metal bicarbonate;

(2) forming an aqueous basic suspension of magnesium hydroxide;

(3) mixing the solution of part (1) and the aqueous basic suspension of part (2); and (4) heating the resulting mixture to form a precipitate.

19. The smoking article of claim 18, wherein the reaction with carbon dioxide of step (b) (1) (i) or (ii) takes place at from about 14 to about 600 psi.

20. The smoking article of claim 18, wherein the magnesium salt of step (b) (1) (iii) is magnesium chloride and the alkali metal bicarbonate is potassium bicarbonate.

21. The smoking article of claim 18, wherein the magnesium hydroxide of step (b) (2) is prepared by reacting magnesium chloride hexahydrate with water and at least one aqueous basic solution selected from the group consisting of aqueous potassium hydroxide, sodium hydroxide, and ammonium hydroxide.

22. The smoking article of claim 18, said paper wrappers further having a basis weight of between about 15 to about 75 grams per square meter.

23. The smoking article of claim 22, said paper wrapper further having a porosity of between about 2 to about 15 CORESTA units.

24. The smoking article of claim 23, said paper wrapper further comprising between about 2% to about 15% by weight of a sizing agent comprising an alkali metal salt of an acid.

25. The smoking article of claim 24, wherein said sizing agent is selected from the group consisting of sodium fumarate, potassium citrate, sodium citrate, potassium dihydrogen phosphate, potassium succinate, and combinations thereof.

26. A smoking article having reduced sidestream smoke comprising a tobacco rod enveloped by a paper wrapper, said paper wrapper comprising:

(a) plant fiber;

(b) between about 5% to about 45% by weight of a filler, said filler comprising at least 40% of a composition of intergrown hydromagnesite and brucite having a rosette morphology, said hydromagnesite comprising between about 95% to about 40% of said composition and said composition produced by the following process:

(1) forming a first solution by one of the following steps:

(i) mixing magnesium hydroxide, magnesium oxide or a combination thereof with water to form a suspension and reacting the suspension with carbon dioxide;

(ii) reacting an aqueous suspension or solution of at least one magnesium carbonate selected from the group consisting of hydromagnesite, nesquehonite, dypingite, and giorgiosite, with carbon dioxide; or (iii) reacting a magnesium salt with an alkali metal bicarbonate;

(2) forming an aqueous basic suspension of magnesium hydroxide;

(3) mixing the solution of part (1) and the aqueous basic suspension of part (2); and (4) heating the resulting mixture to form a precipitate; and said filler further comprising up to about 60% by weight of an admixture of at least one compound selected from the group consisting of inorganic oxides and inorganic carbonates.

27. The smoking article of claim 26, wherein the reaction with carbon dioxide of step (b) (1) (i) or (ii) takes place at from about 14 to about 600 psia.

28. The smoking article of claim 26, wherein the magnesium salt of step (b) (1) (iii) is magnesium chloride and the alkali metal bicarbonate is potassium bicarbonate.

29. The smoking article of claim 26, wherein the magnesium hydroxide of step (b) (2) is prepared by reacting magnesium chloride hexahydrate with water and an aqueous basic solution selected from the group consisting of aqueous potassium hydroxide, sodium hydroxide, and ammonium hydroxide.

30. The smoking article of claim 26, wherein said admixture compound is at least one member selected from the group consisting of magnesium oxide, magnesite, hydromagnesite, calcium carbonate, and titanium dioxide.

31. The smoking article of claim 26, said paper wrapper further having a basis weight of between about 15 to about 75 grams per square meter.

32. The smoking article of claim 31, said paper wrapper further having a porosity of between about 2 to about 15 CORESTA units.

33. The smoking article of claim 32, said paper wrapper further comprising between about 2% to about 15% by weight of a paper wrapper sizing agent comprising an alkali metal salt of an acid.

34. The smoking article of claim 32, wherein said paper wrapper sizing agent is selected from the group consisting of sodium fumarate, potassium citrate, sodium citrate, potassium dihydrogen phosphate, potassium succinate, and combinations thereof.

* * * * *